US007138365B2

(12) United States Patent
Murayama

(10) Patent No.: US 7,138,365 B2
(45) Date of Patent: Nov. 21, 2006

(54) THICKENER COMPRISING HYDROXYALKYLATED POLYHYDRIC ALCOHOL ETHER COMPOUND AND HIGH-VISCOSITY LIQUID DETERGENT COMPOSITION CONTAINING THE SAME

(75) Inventor: Tomohiro Murayama, Kawagoe (JP)

(73) Assignee: Kawaken Fine Chemical Co., Ltd., Tokyo (JP)

( * ) Notice: Subject to any disclaimer, the term of this patent is extended or adjusted under 35 U.S.C. 154(b) by 197 days.

(21) Appl. No.: 10/484,308

(22) PCT Filed: Jul. 19, 2002

(86) PCT No.: PCT/JP02/07361

§ 371 (c)(1),
(2), (4) Date: Jan. 20, 2004

(87) PCT Pub. No.: WO03/008527

PCT Pub. Date: Jan. 30, 2003

(65) Prior Publication Data

US 2004/0214739 A1 Oct. 28, 2004

(30) Foreign Application Priority Data

Jul. 19, 2001 (JP) ..... 2001-220255

(51) Int. Cl.
*C11D 3/20* (2006.01)
*C11D 3/26* (2006.01)
*C11D 1/90* (2006.01)
*C11D 17/08* (2006.01)

(52) U.S. Cl. ..... 510/506; 510/356; 510/490; 510/503; 510/505

(58) Field of Classification Search ..... 510/356, 510/505, 506, 490, 503
See application file for complete search history.

(56) References Cited

U.S. PATENT DOCUMENTS 3,427,248 A * 2/1969 Lemair et al. ..... 510/127

FOREIGN PATENT DOCUMENTS

| | | |
|---|---|---|
| EP | 303187 | 8/1988 |
| JP | 5449322 | 4/1979 |
| JP | 6467235 | 3/1989 |
| JP | 7173486 | 7/1995 |
| JP | 11315043 | 11/1999 |
| JP | 200017283 | 1/2000 |
| JP | 2001-181696 | 7/2001 |
| JP | 2002-180086 | 6/2002 |
| JP | 2002-226825 | 8/2002 |

* cited by examiner

*Primary Examiner*—Brian P. Mruk
(74) *Attorney, Agent, or Firm*—Millen, White, Zelano & Branigan, P.C.

(57) ABSTRACT

HYDROXYALKYL polyhydric alcohol ether compounds of the general formulae (I) and (II) have excellent thickening effect and stability at low temperature, are useful as a thickening agent usable for the preparation of liquid detergents, can be produced by a condensation reaction of 1,2-epoxyalkanes of the formula (III) with aliphatic diols of the formula (IV), and are usable for the production of liquid detergent compositions, together with various surfactants (except for cationic surfactants), particularly sulfur atom-containing anionic surfactants or dipolar-ionic surfactants (I)

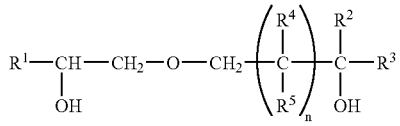

(II)

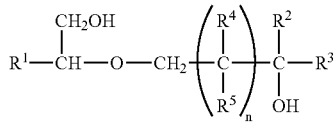

(III)

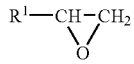

(IV)

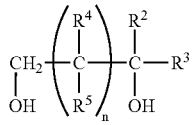

$R^1$ = $C_8$–$C_{18}$ alkyl or alkenyl, $R^2$, $R^3$, $R^4$, $R^5$ = H or $C_1$–$C_3$ alkyl and n = 0 to 3.

10 Claims, No Drawings

THICKENER COMPRISING HYDROXYALKYLATED POLYHYDRIC ALCOHOL ETHER COMPOUND AND HIGH-VISCOSITY LIQUID DETERGENT COMPOSITION CONTAINING THE SAME

TECHNICAL FIELD

The present invention relates to a thickening agent containing a hydroxyalkyl polyhydric alcohol ether compound and a liquid detergent composition containing the hydroxyalkyl polyhydric alcohol ether compound-containing thickening agent and having an enhanced foaming property, foam-stability and stability at low temperatures.

BACKGROUND ART

It is known that, for the purpose of increasing a viscosity of a detergent composition to enhance a practical handling property of the detergent composition, or to stably disperse a water-insoluble substance, for example, a pearl brightening agent, an abrasive, etc, in the detergent composition, various types of thickening agents are mixed into the detergent composition.

As conventional main thickening methods, a method in which an inorganic salt, for example, sodium chloride is mixed into the detergent composition to agglomerate the micelles of the detergent with each other; a method in which a thickening polymeric agent is mixed into the detergent composition, and a method in which electrical mutual actions generated between the molecules of surfactant compounds in the detergent composition, are utilized for thickening the composition.

As a most common thickening method, it is known to use fatty acid alkanolamides as thickening agents. The fatty acid alkanolamides are surface-active agents exhibiting very excellent thickening (viscosity-increasing) effects and foam-stabilizing effects, particularly when used in combination with an anionic surface active agent. However, the fatty acid alkanolamides contain a nitrogen atom in the molecular structure thereof and, thus, in some surface active agent compositions, an undesired coloration of the composition unavoidably occurs with a lapse of time. Accordingly, development of a new type of thickening agent having a thickening property equal to or more than that of the fatty acid alkanolamides but not containing nitrogen atom in the molecular structure thereof has been demanded.

As a non-ionic surface active compound containing nitrogen atom and utilizable as a thickening agent, compounds having a very long polyoxyethylene chain segment, for example, polyethylene glycol distearate having a high addition degree of a polyoxyethylene segment, are known, and a method in which the above-mentioned compounds are used to exhibit the thickening effect thereof, is also known. This type of compounds has, however, a chemical structure similar to that of polymeric compounds and thus a problem such that when the compound is mixed, as a thickening agent, in a detergent composition, the compound causes the resultant mixture to exhibit an unpleasant slippery feel, occurs.

With respect to derivative compounds from hydroxyalkyl polyhydric alcohol ether, Japanese Unexamined Patent Publication No. 54-49322 (JP-54-49322-A) discloses that the derivative compound is used as a non-medical anti-bacterial and mildew-proofing agent. In this Japanese publication, it is reported that a hydroxyalkyl polyhydric alcohol ether compound having an excellent anti-bacterial and mildew-proofing property can be obtained when ethyleneglycol is used as a polyhydric alcohol.

Also, in a rust preventive lubricant agent for zinc-plated steel sheet disclosed in Japanese Unexamined Patent Publication No. 7-173486 (JP-7-173486-A), an additive for lubricant oils and a lubricant oil composition disclosed in Japanese Unexamined Patent Publication No. 2000-17283 (JP-2000-17283-A), hydroxyalkyl polyhydric alcohol ether compounds having a fluidity-enhancing effect and a rust preventive effect are employed. However, none of the above-mentioned prior art publications discloses that the hydroxyalkyl polyhydric alcohol ether compounds are mixed, as a thickening agent, into detergents. Namely, in the above-mentioned publications, the employment of the hydroxyalkyl polyhydric alcohol ether compounds for the purpose of cleaning or lavation is not disclosed.

With respect to the use as a detergent, Japanese Unexamined Patent Publication No. 01-67235 (JP-01-67235-A) discloses a method in which, in the preparation of an aqueous ionic surface active agent-containing detergent, hydroxyalkyl polyhydric alcohol ether compounds are mixed into water-soluble ionic surface active agents, is disclosed. In this prior method, the employed polyhydric alcohols include ethylene glycol, glycerol, erythritol, pentaerythritol, trimethylolpropane, sorbitol, cyclohexanetriol and inositol. Further, the publication reports that in consideration of the degree of increase in the viscosity of the mixture of the water-soluble ionic surface active agent with the polyhydric alcohol, glycerol and trimethylol propane are preferably employed as the polyhydric alcohols.

In fact, although hydroxydodecyl glycelylether produced from glycerol and 1,2-epoxydodecane can be used as a viscosity-modifier of the surface active agent composition, this compound has a problem such that the compound has a very high melting point and causes the resultant composition to exhibit a decreased stability at low temperature. Therefore, the compound has a low usability in practice.

Japanese unexamined Patent Publication No. 11-315043 (JP-11-315043-A) discloses a composition in which a hydroxyalkyl polyhydric alcohol ether compound prepared by using a solid acid catalyst is mixed into a detergent. The Japanese publication reports that, in the preparation of the ether compound, the polyhydric alcohol is preferably selected from polyhydroxy compounds, for example, glycerol, diglycerol, triglycerol, tetraglycerol, polyglycerol, glucose, methylglucoside, ethylglucoside, alkyl polyglucoside, sorbitol, mannitol, and pentaerythritol. The hydroxyalkyl polyhydric alcohol ether compounds produced from the above-mentioned polyhydroxy compounds exhibit an enhanced solubility in water. However, the compound is not always satisfactory in the thickening effect on the detergent, in comparison with that of the conventional fatty acid alkanolamide compounds.

SUMMARY OF THE INVENTION

An object of the present invention is to provide a thickening agent comprising a hydroxyalkyl polyhydric alcohol ether compound not only having an excellent thickening effect but also not affecting the stability at low temperature and the foaming property of the composition containing the agent, and a liquid detergent composition containing the same.

The inventors of the present invention have made extensive research to develop a new non-nitrogen-containing thickening agent comparable to the conventional fatty acid alkanolamide compounds, and as a result, found that hydroxyalkyl polyhydric alcohol ether compound having a specific chemical structure exhibits a comparable thickening effect to the fatty acid alkanolamide compounds and contributes to enhancing stability at low temperature, to improving the foaming property and to enhancing the foam stability of the composition, and the present invention was completed on the basis of the above-mentioned findings.

The thickening agent of the present invention comprises at least one hydroxyalkyl polyhydric alcohol ether compound selected from those of the general formulae (1) and (2):

(1)

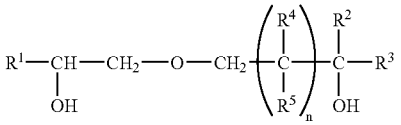

and (2)

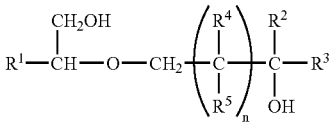

in which formulae (1) and (2), $R^1$ represents an alkyl or alkenyl group having 8 to 18 carbon atoms, $R^2$, $R^3$, $R^4$ and $R^5$ respectively and independently from each other represent a hydrogen atom or an alkyl group having lo to 3 carbon atoms, and n represents an integer of 0 to 3.

In the hydroxyalkyl polyhydric alcohol ether compound-comprising thickening agent of the present invention, in the general formulae (1) and (2) representing the hydroxyalkyl polyhydric alcohol ether compounds, preferably both $R^4$ and $R^5$ represent a hydrogen atom and either one of $R^2$ and $R^3$ represents a methyl group.

In the hydroxyalkyl polyhydric alcohol ether compound-comprising thickening agent of the present invention, each of the hydroxyalkyl polyhydric alcohol ether compounds of the general formulae (1) and (2) preferably has a HLB value of 6 to 9, determined in accordance with the Organic Conception Diagram.

In the hydroxyalkyl polyhydric alcohol ether compound-comprising thickening agent of the present invention, the hydroxyalkyl polyhydric alcohol ether compounds of the general formulae (1) and (2) preferably selected from condensation reaction products of 1,2-epoxy compounds represented by the general formula (3) with aliphatic diol compounds represented by the general formula (4):

(3)

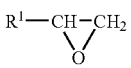

and (4)

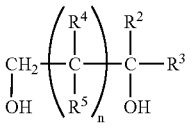

in which formulae (3) and (4), $R^1$, $R^2$, $R^3$, $R^4$ and $R^5$ are as defined above and n is as defined above.

In the hydroxyalkyl polyhydric alcohol ether compound-comprising thickening agent of the present invention, the aliphatic diol compounds by the general formula (4) are preferably selected from 1,2-propane dial, 1,2-butane diol and 1,3-butane diol.

The liquid detergent composition of the present invention comprising a thickening agent component comprises the hydroxyalkyl polyhydric alcohol ether compound-comprising thickening agent of the present invention as mentioned above, and a liquid detergent component comprising at least one member selected from anionic surfactants, amphoteric surfactants, dipolar-ionic surfactants, semipolar-ionic surfactants and non-ionic surfactants different from the hydroxyalkyl polyhydric alcohol ether compounds of the formulae (1) and (2).

In the liquid detergent composition of the present invention, the liquid detergent component preferably comprises at least one member selected from sulfur atom-containing anionic surfactants and sulfur atom-containing dipolar-ionic surfactants.

In the liquid detergent composition of the present invention, the liquid detergent component preferably comprises at least one member selected from acetic acid betaine surfactants and amidoamine type amphoteric surfactants represented by the general formula (5);

(5)

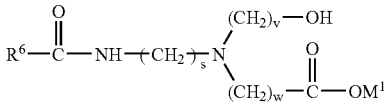

[in which formula (5), $R^6$—CO represents a residue group of an aliphatic acid having 10 to 18 carbon atoms, s represents an integer of 2 or 3 and $M^1$ represents an alkali metal atom or an alkanolamine residue group] and semipolar-ionic surfactants.

In the liquid detergent composition of the present invention, the liquid detergent component preferably comprises at least one member selected from carboxyl group-containing anionic surfactants, acetic acid betaine type surfactants, the amide amine type amphoteric surfactants represented by the general formula (5), dipolar-ionic surfactants and semipolar-ionic surfactants.

In the liquid detergent composition of the present invention, the thickening agent component and the liquid detergent component are present at a dry mass ratio of 1:99 to 40:60.

BEST MODE OF CARRYING OUT THE INVENTION

In the thickening agent of the present invention, the hydroxyalkyl polyhydric alcohol ether compounds which are contained as a principal component in the thickening agent, are those represented by the general formulae (1) and (2). The compounds of the formulae (1) and (2) can be produced by condensation-reacting 1,2-epoxy compounds represented by the formula (3) with aliphatic diol compounds represented by the formula (4) in the presence or absence of a catalyst.

In the case where the condensation reaction of the 1,2-epoxy compounds of the formula (3) with the aliphatic diol compounds of the formula (4) is carried out in the presence of a catalyst, either one of acid catalyst and basic catalyst can be employed. However, the resultant hydroxyalkyl polyhydric ether compounds produced in the presence of the acid catalyst are different in composition of the resultant compounds, namely a product amount ratio of the compounds of the general formula (1) to the compounds of the general formula (2), from those produced in the presence of the basic catalyst.

In the case where the acid catalyst is employed, the proportion of the compounds of the general formula (2) based on the total amount of in the resultant compounds is higher than that of the compound of the general formula (1). Compared with this, the employment of the basic catalyst causes the proportion of the compound of the general formula (1) to be higher than that of the general formula (2).

In comparison with the compounds of the general formula (2), the compounds of the general formula (1), which are identical in $R^1$ to $R^5$ to the compounds of the general formula (2), have a higher melting point. Thus, a problem such that when the proportion of the compounds of the formula (1) is higher than that of the formula (2), based on the total amount of the resultant reaction product, the resultant thickening agent exhibits an unsatisfactory handling property and the resultant thickening agent-containing composition exhibit an insufficient stability at low temperature, occurs. In view of the above-mentioned problem, the acid catalyst which causes the proportion of the compounds of the general formula (2) in the reaction product to be high is preferably employed. Also, the proportion of the compounds of the formula (2) based on the total mass of the compounds of the formulae (1) and (2) is preferably controlled to 50% by mass or more. Further, the mass ratio of the content of the compounds of the formula (1) to that of the formula (2) can be appropriately established in response to the purpose of using the target thickening agent.

The acid catalyst for the condensation reaction of the 1,2-epoxy compounds of the formula (3) with the aliphatic diol compounds of the formula (4) preferably comprises at least one member selected from sulfuric acid, hydrochloric acid, nitric acid, phosphorous acid, phosphoric acid, p-toluenesulfonic acid, m-xylenesulfonic acid and boron trifluoside-ether complex, and is used in an amount of 0.0001 to 0.1 mole per mole of the epoxy compound subjected to the condensation reaction. The basic catalyst preferably comprises at least one member selected from sodium hydroxide, potassium hydroxide, calcium hydroxide, magnesium hydroxide, barium hydroxide, sodium methoxide, sodium ethoxide, metallic sodium, metallic potassium and metallic lithium, and used in an ampount of 0.0001 to 0.1 mole per mole of the epoxy compound subjected to the reaction.

The condensation reaction of the compounds of the formula (3) with the compounds of the formula (4) is preferably carried out at a temperature of 30 to 150° C. for 10 minutes to 2 days. There is no specific limitation to the reaction pressure. Usually, the condensation reaction is carried out under the ambient atmospheric pressure.

The 1,2-epoxy compounds of the formula (3) are preferably selected from 1,2-epoxydecane, 1,2-epoxydodecane, 1,2-epoxytetradecane, 1,2-epoxyhexadecane and 1,2-epoxyoctadecane, more preferably from 1,2-epoxydecane, 1,2-epoxydodecane and 1,2-epoxytetradecane. These compounds may be employed alone or in a mixture of two or more thereof.

The aliphatic diol compounds of the general formula (4) include ethylene glycol, 1,2-propanediol, 1,3-propanediol, 1,2-butanediol, 1,3-butanediol, 1,4-butanediol, 3-methyl-1,3-butanediol, 1,2-pentanediol, 1,5-pentanediol and 2-methyl-2,4-pentanediol. These compounds may be employed alone or in a mixture of two or more thereof.

The hydroxyalkyl polyhydric alcohol ether compounds usable for the thickening agent of the present invention exhibit a very low solubility in water and therefore the viscosity of water cannot be increased by the compounds alone. When the hydroxyalkyl polyhydric alcohol ether compound-containing thickening agent is mixed in a liquid detergent optionally together with a component capable of solubilizing the resultant thickening agent composition of the present invention in water, the viscosity and foaming property of the resultant detergent composition can be improved by the thickening agent.

This feature will be further explained below.

Each of the hydroxyalkyl polyhydric alcohol ether compounds of the formulae (1) and (2) preferably has a HLB value of 6.0 to 9.0, more preferably 7.0 to 8.8, determined in accordance with the Organic Conception Diagram of each compound.

The HLB value determined in accordance with the Organic Conception Diagram is one calculated in accordance with the following equation.

$$HLB\ \text{value} = \Sigma\text{organicity}/\Sigma\text{inorganicity} \times 10$$

When the compounds of the formulae (1) and (2) have an HLB value of 6.0 to 9.0, they can exhibit a high thickening effect on the liquid detergent.

The mechanism of exhibiting a high thickening effect when the hydroxyalkyl polyhydric alcohol Ether compounds have an HLB value of 6.0 to 9.0 is not completely clear. It is assumed that when the hydroxyalkyl polyhydric alcohol ether compounds of the formulae (1) and (2) are contained and dissolved in the liquid detergent composition, the compounds of the formulae (1) and (2) and the component in which the compounds of formulae (1) and (2) are dissolved are mixed with each other to form mixture micelles which exhibit the thickening effect on the detergent. Also, it is assumed that when the mixture micelles are formed, the thickening effect is variable in response to a position in each micelle in which position the hydroxyalkyl polyhydric alcohol ether compound of the formula (1) or (2) is dissolved in the mixture micelle.

In the hydroxyalkyl polyhydric ether compound having an HLB value of 6.0 to 9.0, when a hydrophilic moiety of the molecule of the compound has a methyl group, in the general formulae (1) and (2), preferably at least one of $R^2$ to $R^5$ represents a methyl group, more preferably one of $R^2$ and $R^3$ represents a methyl group, the resultant thickening agent of the present invention is caused to be in the state of a liquid or paste at room temperature, so as to enhance the handing property of the thickening agent itself, and, simultaneously, the stability at low temperature of the liquid detergent composition containing the thickening agent of the present invention is improved.

In the compounds of the formulae (1) and (2), it is assumed that the reasons for such a phenomenon are that, when the methyl group is located in the hydrophilic moiety of the compounds, the resultant thickening agent per se exhibits a high stability in liquid state at room temperature, and stability at low temperature of the detergent composition containing the thickening agent is enhanced, is due to the crystallization of the hydroxyalkyl polyhydric alcohol ether compound being three-dimensionally hindered by the methyl group introduced into the hydrophilic moiety of the molecule of the compound.

In the case where an alkyl group longer than the methyl group is introduced into the hydrophilic moiety, an improvement in the foaming stability of the resultant thickening agent-containing detergent composition is not confirmed and, in the case where the alkyl group is extremly long (having 4 or more carbon atoms), no growth of the mixture micelles of the resultant hydroxyalkyl polyhydric alcohol ether compound and the component by which the compound is dissolved in the detergent composition occurs and the resultant compound exhibits a poor thickening effect.

As referential data, Table 1 shows the HLB values of the hydroxyalkyl polyhydric alcohol ether compounds of the formulae (1) and (2) in which $R^1=C_{10}H_{21}$ group, and the polyhydric alcohol groups are as shown in Table 1.

TABLE 1

| $R^1$ | Polyhydric alcohol | HLB value |
|---|---|---|
| $C_{10}H_{21}$ | Ethylene glycol | 8.15 |
| $C_{10}H_{21}$ | Propylene glycol | 7.86 |
| $C_{10}H_{21}$ | 1,3-butylene glycol | 7.33 |
| $C_{10}H_{21}$ | Glycerol | 11.43 |

For the above-mentioned reasons, among the aliphatic diol compounds of the general formula (4), 1,2-propanediol, 1,2-butanediol, 1,3-butanediol and 3-methyl-1,3-butanediol are easily available and cause the resultant hydroxyalkyl polyhydric alcohol ether compound to exhibit a low melting temperature, and the resultant composition produced by mixing the hydroxyalkyl polyhydric alcohol ether compound into the liquid detergent to exhibit a high thickening effect and a good stability at low temperature and, thus, are specifically preferred.

The high viscosity liquid detergent composition containing the thickening agent of the present invention will be explained below.

In the detergent composition, the component for solubilizing the thickening agent of the present invention in water includes anionic surfactants, amphoteric surfactants, dipolar-ionic surfactants and semipolar-ionic surfactants.

Particularly, a combination of the thickening agent of the present invention with a sulfur-containing anionic surfactant and/or a dipolar-ionic surfactant exhibits a significant thickening effect.

The sulfur-containing anionic surfactants and the dipolar-ionic surfactants will be further explained below.

The sulfur-containing anionic surfactants include, for example, sulfate ester type anionic surfactants and sulfonic acid type anionic surfactants.

(A) Sulfate Ester Type Anionic Surfactants

1. Higher Alkyl Sulfate Ester Salts of the Following Formula (6)

$$(R^7\text{—O—}SO_3)_pM^2 \tag{6}$$

In the formula (6), $R^7$ represents an alkyl or alkenyl group having 10 to 18 carbon atoms, $M^2$ represents an alkali metal atom, alkaline earth metal atom or alkanolamine residue, p represents an integer equal to the number of electric charge on $M^2$.

In the compounds of the formula (6), for example, sodium laurylsulfate, potassium laurylsulfate and triethanolamine laurylsulfate are useful for the detergent composition of the present invention.

2. Alkylethersulfate Ester Salts Represented by the Following Formula (7)

$$(R^8\text{—}(O\text{—}C_2H_4)_q\text{—O—}SO_3)_pM^3 \tag{7}$$

In the formula (7), $R^8$ represents an alkyl or alkenyl group having 10 to 18 carbon atoms, $M^3$ represents an alkali metal atom, alkaline earth metal atom or alkanolamine residue, q represents an integer of 1 to 5 and p represents an integer equal to the number of electric charge of $M^3$.

In the compounds of the formula (7), for example, triethanolamine POE lauryl sulfate and sodium POE laurylsulfate (in which "POE" represents a polyoxyethylene group) are useful for the detergent composition of the present invention.

3. Polyoxyethylene Hither Fatty Acid Alkylolamidosulfate Ester Acids Represented by the Following Formula (8);

$$\left(R^9\text{—}\overset{\overset{\displaystyle O}{\|}}{C}\text{—NH—}C_2H_4(O\text{—}C_2H_4)_q\text{—O—}SO_3\right)_pM^4 \tag{8}$$

In the formula (8), $R^9$—CO represents a residue of a fatty acid having 10 to 18 carbon atoms, $M^4$ represents an alkali metal atom, alkaline earth metal atom or alkanolamine residue, q represents an integer of 1 to 5, and p represents an integer equal to the number of electric charge on $M^4$.

The compounds of the formula (8) preferably include, for example, sodium POE lauric acid monoethanolamidosulfate salt, sodium POE coconut oil fatty acid monoethanolamidosulfate salt.

(B) Sulfonic Acid Type Anionic Surfactants

1. Alkylbenzenesulfate Salts Represented by the Following Formula (9)

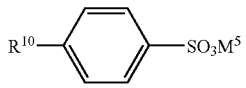

(9)

In the formula (9), $R^{10}$ represents an alkyl or alkenyl group having 10 to 18 carbon atoms, and $M^5$ represents an alkali metal atom or an alkanolamine residue.

The compounds of the formula (9) preferably include, for example, sodium linear dodecylbenzenesulfonate salt and triethanolamine linear dodecylbenzenesulfonate salt.

2. Higher Fatty Acid Amidosulfonate Salts Represented by the Following Formula (10)

$$\left(R^{11}\text{—}\overset{\overset{\displaystyle O}{\|}}{C}\text{—}\overset{\overset{\displaystyle R^{12}}{|}}{N}\text{—}CH_2\text{—}CH_2\text{—}SO_3\right)_pM^6 \tag{10}$$

In the formula (10), $R^{11}$—CO represents a residue of a fatty acid having 10 to 18 carbon atoms, $R^{12}$ represents a substituent selected from a hydrogen atom and methyl and ethyl groups, $M^6$ represents an alkali metal atom, an alkaline earth metal atom or an alkanolamine residue and p represents an integer equal to the number of electric charge on $M^6$.

The compounds of the formula (10) preferably include, for example, sodium N-myristoyl-N-methyltaurine salt, sodium coconut oil fatty acid methyltaurine salt, sodium lauroylmethyltaurine salt, and triethanolamine lauroyltaurine salt.

3. Isethionate Salts Represented by the Following Formula (11)

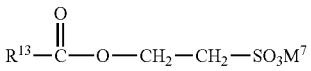

(11)

In the formula (11), $R^{13}$—CO represents a fatty acid residue having 10 to 18 carbon atoms, and $M^7$ represents an alkali metal atom or an alkanolamine residue.

The compounds of the formula (11) preferably include, for example, sodium coconut oil fatty acid ethylestersulfonate salt.

4. Alkylsulfonate Salts Represented by the Following Formula (12)

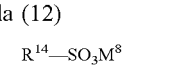

(12)

In the formula (8), $R^{14}$ represents an alkyl or alkenyl group having 10 to 18 carbon atoms and unsubstituted or substituted with a hydroxyl group, $M^8$ represents an alkali metal atom or an alkanolamine residue.

The compounds of the formula (12) preferably include, for example, paraffin-sulfonate salts, and α-olefin-sulfonate salts.

The dipolar-ionic surfactant is a generic term of surfactants having, in the state of a solution in water at a pH of 2 to 11, a chemical molecular structure in which a cationic moiety and an anionic moiety are always included, and is usually used as a liquid detergent. The thickening agent of the present invention exhibits a significant thickening effect when it is used in combination with a dipolar-ionic surfactant containing a sulfur atom.

The sulfur atom-containing dipolar-ionic surfactants include sulfo-betain type dipolar-ionic surfactants represented by the following formula (13):

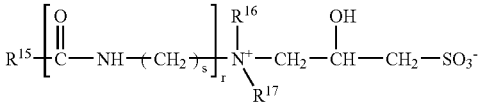

(13)

In the formula (13), r represents an integer of 0 or 1, $R^{15}$ represents an alkyl or alkenyl group having 10 to 18 carbon atoms when r represents 0, or a fatty acid residue having 10 to 18 carbon atoms when r represents 1, $R^{16}$ and $R^{17}$ respectively and independently from each other represent a hydrogen atom or a substituent group selected from methyl and ethyl groups, s represents an integer of 2 or 3.

The compounds of the formula (13) is preferably selected from, for example, lauric acid amide propylhydroxysulfobetaine, coconit oil fatty acid amide propylhydroxysulfobetaine and laurylhydroxysulfobetaine.

In the case where the above-mentioned sulfur atom-containing anionic surfactants, and dipolar-ionic surfactants are used in combination with the thickening agent composition of the present invention, a significantly high thickening effect is obtained.

The combination of the thickening agents of the present invention with surfactants having, as a hydrophilic group, a carboxyl group or a amineoxide group will be explained in detail below.

Where the thickening agent of the present invention is used in a detergent composition comprising two components, a combination of the two components with amphoteric surfactants having, as a hydrophilic group, a carboxyl group or a semipolar-ionic surfactants having, as a hydrophilic group, an amineoxide group, enables the thickening agent of the present invention to exhibit a significant thickening effect.

The amphoteric surfactants containing, as a hydrophilic group, a carboxyl group and causing the thickening agent of the present invention mixed therewith to exhibit a significant thickening effect are selected from acetic acid betaine type amphoteric surfactants and amidoamine type amphoteric surfactants having a specific chemical structure.

1. Acetic Acid Betaine-type Amphoteric Surfactants

The acetic acid betaine type amphoteric surfactants include the surfactants of the general formula (14) shown below.

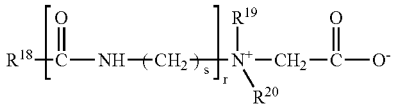

(14)

In the formula (14), r represents an integer of 0 or 1, $R^{19}$ represents an alkyl or alkenyl group having 10 to 18 carbon atoms when r represent 0, or a fatty acid residue having 10 to 18 carbon atoms when r represents 1, $R^{19}$ and $R^{20}$ respectively and independently from each other represent a hydrogen atom or a substituent group selected from methyl and ethyl groups, s represents an integer of 2 or 3.

The compounds of the formula (14) are preferably selected from, for example, lauryldimethylacetic acid betaine, lauric acid amidopropyl betaine, coconut oil fatty acid amidopropyl betaine, and myristic acid amidopropyl betaine.

2. Amidoamine Type Amphoteric Surfactants Having a Specific Structure Represented by the Above-mentioned Formula (5)

The amidoamine type amphoteric surfactants having a specific structure preferably include the amidoamine type amphoteric surfactants having the specific structure represented by the above-mentioned general formula (5).

The compound of the formula (5) preferably include, for example, sodium N-lauroyl-N'-carboxymethyl-N'-hydroxyethylethylenediamine, sodium N-myrisyl-N'-carboxymethyl-N'-hydroxyethylethylenediamine, and sodium N-coconit oil fatty acid-N'-carboxymethyl-N'hydroxyethyl ethylenediamine.

The surfactants represented by the general formula (5) have a chemical structure formed by hydrolysing a conventional surfactants which are referred to as imidazolinium betaine type amphoteric surfactants. It is well known that the structures of the conventional compound which are referred to as imidazolinium betaine type amphoteric surfactants are changed to various complicated structures due to the hydrolysis of the imidazoline ring portion thereof during the production procedure of the surfactants. (For example, as shown in Japanese Examined Patent Publication No. 59-51532 and No. 35-4762 and Cosmet Toiletries, Vol. 95, No. 11, p 45–48, 1980.

The imidazolinium betaine type surfactants may be changed, by hydrolysis, into the chemical structure represented by the following general formula (15).

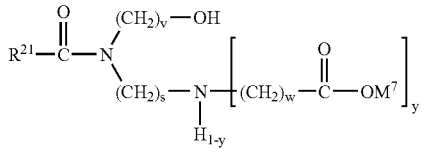

(15)

In the formula (15), $R^{21}$—CO represents a fatty acid residue having 10 to 18 carbon atoms, s represents an integer of 2 or 3, v and w respectively and independently from each other represent an integer of 1 to 3, and $M^7$ represents an alkali metal atom or an alkanolamine residue.

The semipolar-ionic surfactants having, as a hydrophilic group, an amineoxide group may include the compounds represented by the following general formula (16).

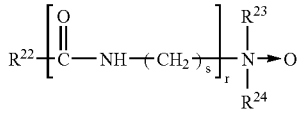

(16)

In the formula (16), r represents an integer of 0 or 1, $R^{22}$ represents an alkyl or alkenyl group having 10 to 18 carbon atoms when r represents 0, or a fatty acid residue having 10 to 18 carbon atoms when r represents 1, $R^{23}$ and $R^{24}$ respectively and independently from each other represent a hydrogen atom or an substituent group selected from methyl and ethyl groups and s represents an integer of 2 or 3.

The compounds of the formula (16) are preferably selected from, for example, lauryldimethylamineoxide, myristyldimetbylamineoxide, lauric acid amidopropyl dimethylamineoxide, and coconut oil fatty acid amidopropyl dimethylamineoxide.

In the high viscosity liquid detergent composition of the present invention, the content of the thickening agent of the present invention will be explained below.

In the liquid detergent composition of the present invention, the dry weight ratio of a component consisting of the thickening agent of the present invention to a component consisting of the liquid detergent is preferably in the range of from 1:99 to 40:50.

In the case where the thickening agent of the present invention is used together with a component by which the thickening agent is solubilized in water, the thickening agent exhibits a significant thickening effect on the resultant detergent composition. In this case, the thickening agent contained in the detergent composition is preferably in a content of 2.5 to 43 parts by mass, more preferably 5 to 25 parts by mass, per 100 parts by mass of the total content of the anionic surfactants, amphoteric surfactants, dipolar-ionic surfactants and/or semipolar-ionic surfactants which contribute to solubilizing the thickening agent.

If the content of the thickening agent of the present invention is less than 2.5 parts by mass per 100 parts by mass of the surfactants contributing to solubilizing the thickening agent in the detergent composition, a thickening effect of the thickening agent for the detergent composition may be insufficient. Also, if the content of the thickening agent is more than 43 parts by mass, the resultant detergent composition may exhibit an unsatisfactory stability at low temperature.

For example, in the case where the content of the surfactants contributing to the solubilizing the thickening agent of the present invention is 20% by mass based on the total mass of the liquid detergent composition, the content of the thickening agent of the present invention is preferably 0.5 to 8.6% by mass, more preferably 1.0 to 5% by mass, based on the total mass of the liquid detergent composition.

The combinations of the thickening agent of the present invention with the surfactants dissolving therein the thickening agent, in which combination, the thickening agent exhibits a significant thickening effect, are shown below.

(a) The thickening agent of the present invention+sulfur atom-containing anions (b) The thickening agent of the present invention+sulfur atom-containing dipolar-ionic surfactants (c) The thickening agent of the present invention+acetic acid betaine type amphoteric surfactants (d) The thickening agent of the present invention+amideamine type amphoteric surfactants of the formula (5)

(e) The thickening agent of the present invention+semipolar-ionic surfactants.

In the other combinations than the above-mentioned combinations, though the thickening agent of the present invention may exhibit an improvement in foaming property of the resultant composition, the thickening effect on the combination is lower than that on the above-mentioned specific combinations. Particularly, in a two component composition containing an anionic surfactant having, as a hydrophilic group, only a carboxyl group, the thickening agent of the present invention exhibits an effect of enhancing the foaming property of the resultant composition and of making the resultant foams creamy, and, however, the thickening effect is lower than that in the above-mentioned combinations (a) to (e).

In the research of thickening conditions on which the carboanion type surfactants are thickened by using the thickening agent of the present invention, it has been found that when the carboanion type surfactants are used together with the combinations (a) to (e), the thickening effect and the foaming property is enhanced and the quality of the resultant foam is improved.

Where the thickening agent of the present invention and at least one member selected from sulfur atom-containing anions, sulfur atom-containing dipolar-ionic surfactants, acetic acid betaine type amphoteric surfactants, amidoamine type amphoteric surfactants of the general formula (5) and semipolar-ionic surfactants are contained in combination with carboanions, in a detergent composition, the carboanions which contribute to enhancing the thickening effect and foaming property and to improving the quality of the foam, include the compounds as shown below.

1. Salts of Fatty Acids or Alkylether Carboxylic Acids of the Following Formula (17)

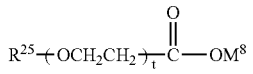

(17)

In the formula (17), $R^{25}$ represents an alkyl or alkenyl group having 10 to 18 carbon atoms, $M^8$ represents a hydrogen atom, an alkali metal atom or an alkanolamine residue, t represents an integer of 0 or 1 to 5.

The compounds of the formula (17) preferably include, for example, sodium laurylethercarboxylate, soap materials, sodium laurate, sodium palmitate, and coconut oil potassium soap.

2. N-Acylamino Acid Salts of the Following Formulae (18) and (19)

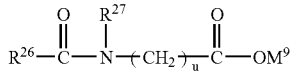

(18)

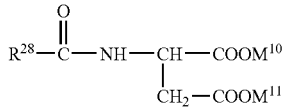

(19)

In the formulae (18) and (19), $R^{26}$—CO represents a fatty acid residue having 10 to 18 carbon atoms, $R^{26}$ represents an alkyl or alkenyl group corresponding to the above-mentioned fatty acid residue, $R^{27}$ represents a hydrogen atom or a substituent group selected from methyl and ethyl groups, u represents an integer of 1 to 3, $M^{10}$ represents an alkali metal atom or an alkanolamine residue, $M^9$ and $M^{11}$ respectively and independently from each other represent a hydrogen atom, an alkali metal atom or an alkanolamine residue.

The compounds of the formulae (18) and (19) preferably include, for example, sodium lauroyl sarcosinate, sodium lauroyl-N-methyl-β-alaninate, monosodium N-lauroyl glutamate, disodium N-stearoyl glutamate, monosodium N-myristoyl-L-glutamate and diethanolamine N-palmitoyl asparagate.

In the detergent composition of the present invention, the mixing proportions of a thickening agent component consisting of the thickening agent of the present invention, the above-mentioned carboanions and a detergent component consisting of at least one member selected from the sulfur atom-containing type anionic surfactants, the sulfur atom-containing dipolar-ionic surfactants, acetic acid betaine type amphoteric surfactants, amideamine type amphoteric surfactants of the general formula (5) and semipolar-ionic surfactants are preferably established so that the mixing proportion of the thickening agent of the present invention is in the range of from 2.5 to 43 parts by mass, more preferably 5 to 25 parts by mass, per 100 parts by mass of the total of all the other components than the thickening agent component.

Further in the detergent composition of the present invention, the mixing mass ratio of the carboanions to at least one member selected from the sulfur atom-containing anions, the sulfur atom-containing dipolar-ionic surfactants, the acetic acid betaine type amphoteric surfactants, the amideamine type amphoteric surfactants of the general formula (5) and the semipolar-ionic surfactants is preferably in the range of from 90:10 to 50:50, more preferably 80:20 to 55:45.

When the proportion of the carboanions is higher than 90:10, the resultant composition may exhibit an insufficient thickening effect, while the foaming property and the foam quality may be somewhat improved. Also, when the proportion is lower than 50:50, the feeling in use of the resultant detergent composition may be governed by the sulfur atom-containing anions, the sulfur atom type dipolar-ionic surfactants, the acetic acid betaine type amphoteric surfactants, the amidoamine type amphoteric surfactants of the general formula (5) and/or the semipolar-ionic surfactants, and the detergent composition having a preferable feeling in use thereof due to the carboanions themselve may not be obtained.

The liquid detergent containing the thickening agent composition of the present invention optionally further contains at least one additive selected from, for example, extracts and powdery materials derived from animals, plants, fish, shellfish and microorganisms, liquid oils and fats, solid oils and fats, waxes, hydrocarbons, higher alcohols, esters, silicones, humectants, water-soluble polymers, film-coating agents, ultraviolet-ray absorbers, extinguishing agents, sequestering agents, lower alcohols, saccharides, amino acids, organic amines, synthetic resin emulsions, pH controller, skin-nutritive agents, vitamins, antioxidants, antioxidant additives and perfumes.

EXAMPLES

The present invention will be further explained by the following examples.

Example 1

Synthesis of ethyleneglycol monohydroxydodecyl ether

A reaction vessel equipped with a thermometer, a condenser, a stirrer, a distillation apparatus, a dropping apparatus and a calcium chloride-containing tube and having a capacity of 100 ml was charged with 37.2 g (0.60 mole) of ethylene glycol, and the temperature of the reaction vessel was increased to 50 to 55° C.

Separately, a 100 ml mixing vessel equipped with a calcium chloride-containing tube was charged with 36.9 g (0.20 mole) of 1,2-epoxydodecane. While the charged 1,2-epoxydodecane was stirred and cooled with water, concentrated sulfuric acid was gradually dropped in an amount of 0.4 g (0.004 mole) into the cooled 1,2-epoxydodecane. After stirring for 15 minutes, the resultant mixture was placed into the dropping apparatus attached to the reaction vessel and was dropped into the ethylene glycol contained in the reaction vessel and maintained at a temperature of 50 to 55° C. over a time of 2 hours. Then the reaction of the mixture was carried out at a temperature of 50 to 55° C. for one hour. After the exhaustion of the starting material, namely 1,2-epoxydodecane, was confirmed by a thin-layer chromatography, the reaction was stopped. A saturated aqueous sodium hydrogen carbonate solution was mixed in an amount of 50 ml into the resultant reaction liquid in the reaction vessel, the resultant mixture was stirred for 10 minutes to neutralize the reaction liquid. The reaction liquid was subjected to an extraction procedure using diethyl ether to extract the reaction product. The resultant extraction liquid was concentrated by using a rotary evaporator. An ethylene glycol monohydroxydodecyl ether mixture was obtained in an amount of 48.3 g (yield: 98.1%).

Example 2

Synthesis of 1,2-propanediol monohydroxydodecyl ether

A reaction vessel equipped with a thermometer, a condenser, a stirrer, a distillation apparatus, a dropping apparatus and a calcium chloride-containing tube and having a capacity of 500 ml was charged with 120.98 g (1.59 moles) of 1,2-propanediol, and the temperature of the reaction vessel was increased to 60 to 65° C.

Separately, a 500 ml mixing vessel equipped with a calcium chloride-containing tube was charged with 276.5 g (1.50 moles) of 1,2-epoxydodecane. While the charged 1,2-epoxydodecane was stirred and cooled with water, a concentrated sulfuric acid was gradually dropped in an amount of 2.7 g (0.027 mole) into the cooled 1,2-epoxydodecane. After stirring for 15 minutes, the resultant mixture was placed into the dropping apparatus attached to the reaction vessel and was dropped into the ethylene glycol contained in the reaction vessel and maintained at a temperature of 60 to 65° C. over a time of 2 hours. Then the reaction of the mixture was carried out at a temperature of 60 to 65° C. for one hour. After the exhaustion of the starting material, namely 1,2-epoxydodecane, was confirmed by a thin-layer chromatography, the reaction was stopped. A powdered sodium hydrogen carbonate was mixed in an amount of 2.5 g (0.03 mole) into the resultant reaction liquid in the reaction vessel, the resultant mixture was stirred for 30 minutes to neutralize the reaction liquid. From the reaction liquid, precipitated crystals were separated by filtration. An 1,2-propanediol monohydroxydodecyl ether mixture was obtained in an amount of 395.4 g (yield: 99.5%).

Example 3

Synthesis of 1,2-propanediol monohydroxytetradecyl ether

A reaction vessel equipped with a thermometer, a condenser, a stirrer, a distillation apparatus, a dropping apparatus and a calcium chloride-containing tube and having a capacity of 500 ml was charged with 125.5 g (1.65 moles) of 1,2-propanediol, and the temperature of the reaction vessel was increased to 60 to 65° C.

Separately, a 500 ml mixing vessel equipped with a calcium chloride-containing tube was charged with 318.6 g (1.50 moles) of 1,2-epoxytetradecane. While the charged 1,2-epoxytetradecane was stirred and cooled with water, a concentrated sulfuric acid was gradually dropped in an amount of 2.7 g (0.027 mole) into the cooled 1,2-epoxytetradecane. After stirring for 15 minutes, the resultant mixture was placed into the dropping apparatus attached to the reaction vessel and was dropped into the 1,2-propanediol contained in the reaction vessel and maintained at a temperature of 60 to 65° C. over a time of 2 hours. Then the reaction of the mixture was carried out at a temperature of 60 to 65° C. for one hour. After the exhaustion of the starting material, namely 1,2-epoxytetradecane was confirmed by a thin-layer chromatography, the reaction was stopped. A powdered sodium hydrogen carbonate was mixed in an amount of 2.5 g (0.03 mole) into the resultant reaction liquid in the reaction vessel, the resultant mixture was stirred for 30 minutes to neutralize the reaction liquid. From the reaction liquid, the resultant precipitated crystals were separated by filtration. A 1,2-propanediol monohydroxydodecyl ether mixture was obtained in an amount of 432.0 g (yield: 97.3%).

Example 4

Synthesis of 1,2-propanediol ethyleneglycol monohydroxyoctadecyl ether

A reaction vessel equipped with a thermometer, a condenser, a stirrer, a distillation apparatus, a dropping apparatus and a calcium chloride-containing tube and having a capacity of 1.0 liter was charged with 125.5 g (1.65 moles) of 1,2-propanediol, and the temperature of the reaction vessel was increased to 70 to 75° C.

Separately, a 1.0 liter mixing vessel equipped with a calcium chloride-containing tube was charged with 402.7 g (1.50 moles) of 1,2-epoxyoctadecane. While the charged 1,2-epoxyoctadecane was stirred at room temperature, a concentrated sulfuric acid was gradually dropped in an amount of 2.7 g (0.027 mole) into 1,2-epoxyoctadecane. After stirring for 15 minutes, the resultant mixture was placed into the dropping apparatus attached to the reaction vessel and was dropped into the 1,2-propanediol contained in the reaction vessel and maintained at a temperature of 70 to 75° C. over a time of 2 hours. Then the reaction of the mixture was carried out at a temperature of 70 to 75° C. for one hour. After the exhaustion of the starting material, namely 1,2-epoxydodecane was confirmed by a thin-layer chromatography, the reaction was stopped. A powdered sodium hydrogen carbonate was mixed in an amount of 2.5 g (0.03 mole) into the resultant reaction liquid in the reaction vessel, the resultant mixture was stirred for 30 minutes to neutralize the reaction liquid. From the reaction liquid, the precipitated crystals were separated by filtration. A 1,2-propanediol monohydroxyoctadecyl ether mixture was obtained in an amount of 510.9 g (yield: 96.7%).

Example 5

Synthesis of 1.2-butanediol ethyleneglycol monohydroxydodecyl ether

A reaction vessel equipped with a thermometer, a condenser, a stirrer, a distillation apparatus, a dropping apparatus and a calcium chloride-containing tube and having a capacity of 200 ml was charged with 90.1 g (1.0 mole) of 1,2-butanediol, and the temperature of the reaction vessel was increased to 40 to 45° C.

Separately, a 100 ml mixing vessel equipped with a calcium chloride-containing tube was charged with 36.9 g (0.20 mole) of 1,2-epoxydodecane. While the charged 1,2-epoxydodecane was stirred and cooled with water, a concentrated sulfuric acid was gradually dropped in an amount of 0.4 g (0.004 mole) into the cooled 1,2-epoxydodecane. After stirring for 15 minutes, the resultant mixture was placed into the dropping apparatus attached to the reaction vessel and was dropped into the 1,2-butanediol contained in the reaction vessel and maintained at a temperature of 40 to 45° C. over a time of 2 hours. Then the reaction of the mixture was carried out at a temperature of 40 to 45° C. for one hour. After the exhaustion of the starting material, namely 1,2-epoxydodecane, was confirmed by a thin-layer chromatography, the reaction was stopped. A saturated aqueous sodium hydrogen carbonate solution was mixed in an amount of 50 ml into the resultant reaction liquid in the reaction vessel, the resultant mixture was stirred for 10 minutes to neutralize the reaction liquid. The reaction liquid was subjected to an extraction procedure using diethyl ether to extract the reaction product. The resultant extraction liquid was concentrated by using a rotary evaporator. A 1,2-butanediol monohydroxydodecyl ether mixture was obtained in an amount of 51.2 g (yield: 95.5%).

Example 6

Synthesis of 1,3-butanediol monohydroxydodecyl ether

A reaction vessel equipped with a thermometer, a condenser, a stirrer, a distillation apparatus, a dropping apparatus and a calcium chloride-containing tube and having a capacity of 200 ml was charged with 54.1 g (0.60 mole) of 1,3-butanediol, and the temperature of the reaction vessel was increased to 50 to 55° C.

Separately, a 100 ml mixing vessel equipped with a calcium chloride-containing tube was charged with 36.9 g (0.20 mole) of 1,2-epoxydodecane. While the charged 1,2-epoxydodecane was stirred and cooled with water, a concentrated sulfuric acid was gradually dropped in an amount of 0.4 g (0.004 mole) into the cooled 1,2-epoxydodecane. After stirring for 15 minutes, the resultant mixture was placed into the dropping apparatus attached to the reaction vessel and was dropped into 1,3-butanediol contained in the reaction vessel and maintained at a temperature of 50 to 55° C. over a time of 2 hours. Then the reaction of the mixture was carried out at a temperature of 50 to 55° C. for one hour. After the exhaustion of the starting material, namely 1,2-epoxydodecane was confirmed by a thin-layer chromatography, the reaction was stopped. A saturated aqueous sodium hydrogen carbonate solution was mixed in an amount of 50 ml into the resultant reaction liquid in the reaction vessel, the resultant mixture was stirred for 10 minutes to neutralize the reaction liquid. The reaction liquid was subjected to an extraction procedure using diethyl ether to extract the reaction product. The resultant extraction liquid was concentrated by using rotary evaporator. A 1,3-butanediol monohydroxydodecyl ether mixture was obtained in an amount of 52.8 g (yield: 98.6%).

Example 7

Synthesis of 1,4-butanediol ethyleneglycol monohydroxydodecyl ether

A reaction vessel equipped with a thermometer, a condenser, a stirrer, a distillation apparatus, a dropping apparatus and a calcium chloride-containing tube and having a capacity of 200 ml was charged with 54.1 g (0.60 mole) of 1,4-butanediol, and the temperature of the reaction vessel was raised to 50 to 55° C.

Separately, a 100 ml mixing vessel equipped with a calcium chloride-containing tube was charged with 36.9 g (0.20 mole) of 1,2-epoxydodecane. While the charged 1,2-epoxydodecane was stirred and cooled with water, a concentrated sulfuric acid was gradually dropped in an amount of 0.4 g (0.004 mole) into the cooled 1,2-epoxydodecane. After stirring for 15 minutes, the resultant mixture was placed into the dropping apparatus attached to the reaction vessel and was dropped into 1,4-butanediol contained in the reaction vessel and maintained at a temperature of 50 to 55° C. over a time of 2 hours. Then the reaction of the mixture was carried out at a temperature of 50 to 55° C. for one hour. After the exhaustion of the starting material, namely 1,2-epoxydodecane, was confirmed by a thin-layer chromatography, the reaction was stopped. A saturated aqueous sodium hydrogen carbonate solution was mixed in an amount of 50 ml into the resultant reaction liquid in the reaction vessel, the resultant mixture was stirred for 10 minutes to neutralize the reaction liquid. The reaction liquid was subjected to an extraction procedure using diethyl ether to extract the reaction product. The resultant extraction liquid was concentrated by using a rotary evaporator. A 1,4-butanediol monohydroxydodecyl ether mixture was obtained in an amount of 50.4 g (yield: 94.1%).

Comparative Example 1

Synthesis of ethyleneglycol 1,2-propanediol monohydroxydodecyl ether

A reaction vessel equipped with a thermometer, a condenser, a stirrer, a distillation apparatus, a dropping apparatus and a calcium chloride-containing tube and having a capacity of 2.0 liters was charged with 114.1 g (15 moles) of 1,2-propanediol and 5.79 g (0.03 mole) of a solution of 28% sodium methoxide in methyl alcohol, and the temperature of the reaction vessel was increased to 125 to 130° C., to evaporate off the methyl alcohol. 1,2-epoxydodecane in an amount of 276.5 g (1.50 moles) was added dropwise into 1,2-propanediol maintained at a temperature of 125 to 130° C. through the dropping apparatus over a time of 2 hours. The reaction of the reaction liquid was continued at a temperature of 125 to 130° C.

At the stage at which the reaction time of 3.5 hours lapsed, the exhaustion of the starting material, namely, 1,2-epoxydodecane, was confirmed by a thin-layer chromatograhy, and then the reaction was stopped.

The reaction liquid was mixed with 500 ml of a saturated aqueous ammonium chloride solution and stirred for 10 minutes to neutralize the reaction liquid. The reaction liquid was subjected to an extraction procedure using diethyl ether to extract the reaction product. The resultant extraction liquid was concentrated by using a rotary evaporator. A 1,2-propanediol monohydroxydodecyl ether mixture was obtained in an amount of 359.2 g (yield: 92.0%).

Comparative Example 2

Synthesis of glycerol monohydroxydodecyl ether

A reaction vessel equipped with a thermometer, a condenser, a stirrer, a distillation apparatus, a dropping apparatus and a calcium chloride-containing tube and having a capacity of 100 ml was charged with 20.2 g (0.22 mole) of glycerol, and the temperature of the reaction vessel was rised to 70 to 75° C.

Separately, a 100 ml mixing vessel equipped with a calcium chloride-containing tube was charged with 36.9 g (0.20 mole) of 1,2-epoxydodecane. While the charged 1,2-epoxydodecane was stirred and cooled with water, a concentrated sulfuric acid was gradually dropped in an amount of 0.4 g (0.004 mole) into the cooled 1,2-epoxydodecane. After stirring for 15 minutes, the resultant mixture was placed into the dropping apparatus attached to the reaction vessel and was dropped into glycerol contained in the reaction vessel and maintained at a temperature of 70 to 75° C. over a time of 2 hours. Then the reaction of the mixture was carried out at a temperature of 70 to 75° C. for one hour.

After the exhaustion of the starting material, namely 1,2-epoxydodecane, was confirmed by a thin-layer chromatography, the reaction was stopped. A powdered sodium hydrogen carbonate solution was mixed in an amount of 0.4 g (0.005 mole) into the resultant reaction liquid in the reaction vessel, the resultant mixture was stirred for 30 minutes to neutralize the reaction liquid. From the reaction liquid, precipitated crystals were separated by filtration. A glycerol monohydroxydodecyl ether mixture was obtained in an amount of 55.3 g (yield: 96.7%)

Examples 8 to 35 and Comparative Examples 3 to 32

In each of Examples 8 to 35 and Comparative Examples 3 to 32, a liquid detergent composition having the composition as shown in Tables 2 to 9 was prepared. The resultant composition was subjected to the tests as shown below.

(1) Evaluation of thickening effect (Measurement of viscosity)

Viscometer: B type rotational viscometer Model B8M, made by TOKIMEC K. K.

Measurement temperature; 25° C.

(2) Evaluation of stability at low temperature

Each of samples prepared in the thickening effect evaluation test was left to stand at a temperature of −5° C. for 12 hours, then the sample was taken out from the test and the state of the sample was observed and evaluated into the following two classes.

Class 1: Opalized or crystals are deposited

Class 2: Clear liquid state is kept (3) Measurement of foaming power

Each sample was diluted with distilled water so that the content of solid dissolved substance is adjusted to 0.25% by weight, and the diluted sample was subjected to a LOSS-MILES foaming power measurement at a constant temperature of 40° C.

(4) Feeling in use (foam quality, general evaluation)

Each sample was subjected to use test by 10 testing members, in which test, the sample was used for hand washing and the following properties of the sample were organoloptically evaluated.

Foam-forming property during practical use (volume of foam)

Foam quality (Form of foam, and creaminess of foam)

Hand feeling in rinsing (ease of rinsing, sliminess)

General evaluation of use feel (including stiff feel after washing hand)

The test results are relatively evaluated in fine ranks (one point to fine points), the average of the evaluation results are calculated. The evaluation results are represented in accordance with the averages in the following four classes.

| Average | Evaluation |
|---|---|
| More than 4.5 | Very good (4) |
| 4.5 to 3.5 | Good (3) |
| Less than 3.5 but not less than 3.0 | Standard (2) |
| Less than 3.0 | Bad (1) |

In Examples 8 to 23 and Comparative Examples 3 to 28, the evaluation result of Comparative Example 3 (Table 3) was classified as a standard and given 3 points. Also, in Example 24 to 35 and Comparative Examples 29 to 38, the evaluation result of Comparative Example 38 (Table 9) was classified as a standard and given 3 points.

The test results are shown in Tables 2 to 9.

TABLE 2

| | Example No. Example | | | | | | | | |
|---|---|---|---|---|---|---|---|---|---|
| Item | 8 | 9 | 10 | 11 | 12 | 13 | 14 | 15 | 16 |
| SLES (*)$_1$ | 18% | 16% | 14% | 18% | 16% | 14% | 18% | 16% | 14% |
| Compound of Example 1 | 2% | 4% | 6% | | | | | | |
| Compound of Example 2 | | | | 2% | 4% | 6% | | | |
| Compound of Example 6 | | | | | | | 2% | 4% | 6% |
| Compound of Comparative Example 2 | | | | | | | | | |
| Coconut oil fatty acid diethanolamide | | | | | | | | | |
| Coconut oil fatty acid monoethanolamide | | | | | | | | | |
| pH adjuster | pH = 7 | pH = 7 | pH = 7 | pH = 7 | pH = 7 | pH = 7 | pH = 7 | pH = 7 | pH = 7 |
| Refined water | Balance | Balance | Balance | Balance | Balance | Balance | Balance | Balance | Balance |
| Measured viscosity (mPa · s) | 120 | 6850 | — | 175 | 8800 | 512 | 182 | 5390 | 1820 |
| Stability at low temperature | 3 | 3 | 3 | 3 | 3 | 3 | 3 | 3 | 3 |
| Initial foaming property (mm) | — | — | — | 181.0 | 187.8 | 190.2 | 179.8 | 180.0 | 184.2 |
| Foam quality use test | 4 | 4 | 4 | 4 | 4 | 4 | 4 | 4 | 4 |

Note:

(*)$_1$ . . . SLES: Polyoxyethylene (3) laurylsulfate ester sodium salt (trademark: EMAL 20C, made by KAO K.K.)

TABLE 3

| Item | Example No. Comparative Example 3 | 4 | 5 | 6 | 7 | 8 | 9 |
|---|---|---|---|---|---|---|---|
| SLES $(*)_1$ | 20% | 16% | 14% | 16% | 14% | 16% | 14% |
| Compound of Example 1 | | | | | | | |
| Compound of Example 2 | | | | | | | |
| Compound of Example 6 | | | | | | | |
| Compound of Comparative Example 2 | | 4% | 6% | | | | |
| Coconut oil fatty acid diethanolamide | | | | 4% | 6% | | |
| Coconut oil fatty acid monoethanolamide | | | | | | 4% | 6% |
| pH adjuster | pH = 7 | pH = 7 | pH = 7 | pH = 7 | pH = 7 | pH = 7 | pH = 7 |
| Refined water | Balance | Balance | Balance | Balance | Balance | Balance | Balance |
| Measured viscosity (mPa · s) | 7 | 1340 | 3360 | 100 | 780 | 1600 | 15600 |
| Stability at low temperature | 3 | 1 | 1 | 3 | 3 | 1 | 1 |
| Initial foaming property (mm) | 176.0 | 177.8 | 178.3 | 177.9 | 179.0 | 187.3 | 192.2 |
| Foam quality use test | 1 | 3 | 4 | 3 | 2 | 3 | 3 |

Note:
$(*)_1$ . . . SLES: Polyoxyethylene (3) laurylsulfate ester sodium salt

Tables 2 and 3 clearly show that the thickening agents consisting of the hydroxyalkyl polyhydric alcohol ether compounds produced in Examples 1, 2 and 6 exhibited, in combination with the sulfur atom-containing anionic surfactant, a high thickening effect comparative to that of the conventional fatty acid alkanolamide type nonions.

The thickening agent which was produced in Comparative Example 2 and was a type of hydroxyalkyl polyhydric alcohol ether compound exhibited some degree of thickening effect. However, the resultant thickening effect is low and, in order to obtain a practical thickening effect, the comparative thickening agent must be employed in a large amount in comparison with that of the thickening agents of Examples 1, 2 and 16. Also, the comparative thickening agent had a problem that the stability thereof at low temperature was unsatisfactory.

Also, up to now it was considered that the fatty acid monoalkanolamides exhibit an excellent thickening effect but are insufficient in stability at low temperature. However, it was confirmed that the thickening agent comprising the hydroxyalkyl polyhydric alcohol ether compounds of the present invention is quite satisfactory in the stability at low temperature. Further, it was confirmed that the detergent composition of the present invention comprising a combination of the thickening agent comprising the hydroxyalkyl polyhydric alcohol ether compound with the sulfur atom-containing anionic surfactant can form fine and creamy foam and exhibit a pleasant feel in rinsing procedure in practice.

TABLE 4

| Item | Example No. Example 17 | 18 | Comparative Example 10 | 11 | 12 | 13 | 14 |
|---|---|---|---|---|---|---|---|
| LSB $(*)_2$ | 18% | 16% | 20% | 18% | 16% | 18% | 16% |
| Compound of Example 1 | | | | | | | |
| Compound of Example 2 | 2% | 4% | | | | | |
| Compound of Example 6 | | | | | | | |
| Compound of Comparative Example 2 | | | | | | | |
| Coconut oil fatty acid diethanolamide | | | | 2% | 4% | | |

TABLE 4-continued

| | Example No. | | | | | | |
|---|---|---|---|---|---|---|---|
| | Example | | Comparative Example | | | | |
| Item | 17 | 18 | 10 | 11 | 12 | 13 | 14 |
| Coconut oil fatty acid monoethanolamide | | | | | | 2% | 4% |
| pH adjuster | pH = 7 | pH = 7 | pH = 7 | pH = 7 | pH = 7 | pH = 7 | pH = 7 |
| Refined water | Balance | Balance | Balance | Balance | Balance | Balance | Balance |
| Measured viscosity (mPa · s) | 18 | 1915 | 7 | 13 | 561 | 12 | 920 |
| Stability at low temperature | 3 | 3 | 3 | 3 | 3 | 1 | 1 |
| Initial foaming property (mm) | 189.7 | 191.5 | 181.2 | 183.5 | 186.2 | 190.2 | 193.4 |
| Foam quality use test | 4 | 4 | 1 | 3 | 4 | 4 | 4 |

Note:
$(*)_2$ . . . LSB: Lauric acid amidopropyldimethylaminohydroxysulfobetaine (trademark: Softazoline LSB, made by KAWAKEN FINE CHEMICALS K.K.)

Table 4 clearly shows that when the thickening agent comprising the hydroxyalkyl polyhydric alcohol ether compound prepared in Example 2 exhibited a high thickening effect comparative to the conventional fatty acid alkanolamide type nonions, when it was used in combination with a dipolar-ionic surfactant.

Also, the conventional fatty acid monoalkanolamide has been considered to exhibit a high thickening effect, however, it was unsatisfactory in stability at low temperature. It was confirmed that the hydroxyalkyl polyhydric alcohol ether compound-containing thickening agent was quite satisfactory in stability at low temperature.

Further, it was confirmed that the detergent composition comprising a combination of the hydroxyalkyl polyhydric alcohol ether compound-containing thickening agent with the dipolar-ionic surfactant can provide fine and creamy foam an exhibit a pleasant feel in practical rinsing.

TABLE 5

| | Example No. | | | | | | | | | |
|---|---|---|---|---|---|---|---|---|---|---|
| | Example | | | | | Comparative Example | | | | |
| Item | 19 | 20 | 21 | 22 | 23 | 15 | 16 | 17 | 18 | 19 |
| LPB $(*)_3$ | 18% | 16% | | | | 20% | | | 18% | 16% |
| LAO $(*)_4$ | | | 18% | 16% | | | 20% | | | |
| CH $(*)_5$ | | | | | 18% | | | 20% | | |
| Compound of Example 2 | 2% | 4% | 2% | 4% | 2% | | | | | |
| Compound of Comparative Example 2 | | | | | | | | | | |
| Coconut oil fatty acid diethanolamide | | | | | | | | | 2% | 4% |
| Coconut oil fatty acid monoethanolamide | | | | | | | | | | |
| pH adjuster | pH = 7 | pH = 7 | pH = 7 | pH = 7 | pH = 7 | pH = 7 | pH = 7 | pH = 7 | pH = 7 | pH = 7 |
| Refined water | Balance | Balance | Balance | Balance | Balance | Balance | Balance | Balance | Balance | Balance |
| Measured viscosity (mPa · s) | 14 | 668 | 25 | 781 | 1550 | 8 | 7 | 10 | 10 | 178 |
| Stability at low temperature | 3 | 3 | 3 | 3 | 3 | 3 | 3 | 3 | 3 | 3 |

TABLE 5-continued

| | Example No. | | | | | | | | | |
|---|---|---|---|---|---|---|---|---|---|---|
| | Example | | | | | Comparative Example | | | | |
| Item | 19 | 20 | 21 | 22 | 23 | 15 | 16 | 17 | 18 | 19 |
| Initial foaming property (mm) | 194.2 | 195.3 | 192.0 | 194.5 | 185.2 | 187.3 | 181.2 | 184.8 | 188.6 | 191.9 |
| Foam quality use test | 4 | 4 | 4 | 4 | 4 | 1 | 2 | 2 | 2 | 3 |

Note:
$(*)_3$ . . . LPB: Lauric acid amidopropyldimethylamino-acetic acid betaine (trademark: Softazoline LPB, made by KAWAKEN FINE CHEMICALS K.K.)
$(*)_4$ . . . LAO: Lauric acid amidopropyldimethylamine oxide (trademark: Softazoline LAO-C, made by KAWAKEN FINE CHEMICALS K.K.)
$(*)_5$ . . . CH: Amideamine type amphoteric surfactant comprising, as a principal component, the compound of the general formula (5) (trademark: Softazoline CH, made by KAWAKEN FINE CHEMICALS K.K.)

TABLE 6

| | Example No. Comparative Example | | | | | | | | |
|---|---|---|---|---|---|---|---|---|---|
| Item | 20 | 21 | 22 | 23 | 24 | 25 | 26 | 27 | 28 |
| LPB $(*)_3$ | 18% | 16% | | | | | | | |
| LAO $(*)_4$ | | | 18% | 16% | 18% | 16% | | | |
| CH $(*)_5$ | | | | | | | 18% | 18% | |
| CL $(*)_6$ | | | | | | | | | 18% |
| Compound of Example 2 | | | | | | | | | 2% |
| Compound of Comparative Example 2 | | | | | | | | | |
| Coconut oil fatty acid diethanolamide | | | 2% | 4% | | | 2% | | |
| Coconut oil fatty acid monoethanolamide | 2% | 4% | | | 2% | 4% | | 2% | |
| pH adjuster | pH = 7 | pH = 7 | pH = 7 | pH = 7 | pH = 7 | pH = 7 | pH = 7 | pH = 7 | pH = 7 |
| Refined water | Balance | Balance | Balance | Balance | Balance | Balance | Balance | Balance | Balance |
| Measured viscosity (mPa · s) | 12 | 235 | 14 | 217 | 21 | 352 | 1280 | 4750 | 6 |
| Stability at low temperature | 1 | 1 | 3 | 3 | 1 | 1 | 3 | 1 | 3 |
| Initial foaming property (mm) | 195.2 | 197.8 | 188.5 | 190.6 | 194.2 | 196.7 | 182.4 | 188.9 | 183.1 |
| Foam quality use test | 4 | 4 | 3 | 3 | 4 | 4 | 2 | 4 | 3 |

Note:
$(*)_6$ . . . CL: Amidoamine type amphoteric surfactant comprising, as a principal component, the compound of the general formula (15) (trademark: Softazoline CL, made by KAWAKEN FINE CHEMICALS K.K.)

Tables 5 and 6 clearly show that when the thickening agent comprising the hydroxyalkyl polyhydric alcohol ether compound prepared in Example 2 exhibited a high thickening effect, comparative to the conventional fatty acid alkanolamide type nonions, when it was used in combination with the acetic acid betaine type surfactant, the amideamine type amphoteric surfactant represented by the general formula (5) and a semipolar-ionic surfactant.

Also, the conventional fatty acid monoalkanolamide has been considered to exhibit a high thickening effect, however, it was unsatisfactory in stability at low temperature. It was confirmed that the hydroxyalkyl polyhydric alcohol ether compound-containing thickening agent was quite satisfactory in stability at low temperature.

Further it was confirmed that the detergent composition comprising a combination of the hydroxyalkyl polyhydric alcohol ether compound-containing thickening agent with the acetic acid betaine type surfactant, the amideamine type amphoteric surfactant represented by the general formula (5) and the semipolar-ionic surfactant can provide fine and creamy foam an exhibit a pleasant feel in practical rinsing.

Comparative Example 28 shows that the amideamine type amphoteric surfactant comprising a component, in a high content, represented by the general formula (15), as a specific amideamine type amphoteric surfactant in which the imidazolium betaine skeleton thereof is opened at an irregular position, did not exhibit a thickening effect.

TABLE 7

| Item | Example No. Example 24 | 25 | 26 | 27 | 28 | 29 | 30 | 31 | 32 |
|---|---|---|---|---|---|---|---|---|---|
| LMA $(*)_7$ | 7.20% | 9.00% | 10.80% | 7.20% | 9.00% | 10.80% | 7.20% | 9.00% | 10.80% |
| LPB $(*)_3$ | 10.80% | 9.00% | 7.20% | | | | | | |
| LAO $(*)_4$ | | | | 10.80% | 9.00% | 7.20% | | | |
| CH $(*)_5$ | | | | | | | 10.80% | 9.00% | 7.20% |
| LSB $(*)_2$ | | | | | | | | | |
| Compound of Example 2 | 2% | 2% | 2% | 2% | 2% | 2% | 2% | 2% | 2% |
| Coconut oil fatty acid diethanolamide | | | | | | | | | |
| pH adjuster | pH = 6.5 | pH = 6.5 | pH = 6.5 | pH = 6.5 | pH = 6.5 | pH = 6.5 | pH = 6.5 | pH = 6.5 | pH = 6.5 |
| Refined water | Balance | Balance | Balance | Balance | Balance | Balance | Balance | Balance | Balance |
| LMA | 0.40 | 0.50 | 0.60 | 0.4 | 0.5 | 0.6 | 0.4 | 0.5 | 0.6 |
| Amphoteric surfactant | 0.60 | 0.50 | 0.40 | 0.60 | 0.50 | 0.40 | 0.60 | 0.50 | 0.40 |
| Measured viscosity (mPa · s) | 754 | 254 | 59 | 5000 | 3500 | 420 | 1690 | 1920 | 138 |
| Stability at low temperature | 3 | 3 | 3 | 3 | 3 | 3 | 3 | 3 | 3 |
| Initial foaming property (mm) | 194.2 | 193.1 | 195.4 | 195.4 | 196.2 | 195.8 | 191.2 | 190.7 | 192.4 |
| Foam quality use test | 3 | 4 | 4 | 4 | 4 | 4 | 4 | 4 | 4 |

Note:
$(*)_7$ . . . LMA: N-lauroyl-N-methyl-β-alanine sodium salt (trademark: Alanon ALE, made by KAWAKEN FINE CHEMICALS K.K.)

TABLE 8

| Item | Example No. Example 33 | 34 | 35 | Comparative Example 29 | 30 | 31 | 29 | 30 | 31 |
|---|---|---|---|---|---|---|---|---|---|
| LMA $(*)_7$ | 7.20% | 9.00% | 10.80% | 8.00% | 10.00% | 12.00% | 8.00% | 10.00% | 12.00% |
| LPB $(*)_3$ | | | | 12.00% | 10.00% | 8.00% | | | |
| LAO $(*)_4$ | | | | | | | 12.00% | 10.00% | 8.00% |
| CH $(*)_5$ | | | | | | | | | |
| LSB $(*)_2$ | 10.80% | 9.00% | 7.20% | | | | | | |
| Compound of Example 2 | 2% | 2% | 2% | | | | | | |
| Coconut oil fatty acid diethanolamide | | | | | | | | | |
| pH adjuster | pH = 6.5 | pH = 6.5 | pH = 6.5 | pH = 6.5 | pH = 6.5 | pH = 6.5 | pH = 6.5 | pH = 6.5 | pH = 6.5 |
| Refined water | Balance | Balance | Balance | Balance | Balance | Balance | Balance | Balance | Balance |
| LMA | 0.4 | 0.5 | 0.6 | 0.4 | 0.5 | 0.6 | 0.4 | 0.5 | 0.6 |
| Amphoteric surfactant | 0.6 | 0.5 | 0.4 | 0.6 | 0.5 | 0.4 | 0.6 | 0.5 | 0.4 |
| Measured viscosity (mPa · s) | 4780 | 676 | 110 | 37 | 15 | 7 | 1100 | 350 | 27 |
| Stability at low temperature | 3 | 3 | 3 | 3 | 3 | 3 | 3 | 3 | 3 |
| Initial foaming property (mm) | 193.5 | 193.8 | 194.3 | 190.1 | 189.7 | 189.5 | 190.5 | 191.8 | 191.4 |
| Foam quality use test | 2 | 3 | 4 | 2 | 3 | 3 | 2 | 3 | 4 |

TABLE 9

| Item | Example No. Comparative Example 32 | 33 | 34 | 35 | 36 | 37 | 38 |
|---|---|---|---|---|---|---|---|
| LMA $(*)_7$ | 7.20% | 9.00% | 10.80% | 7.20% | 9.00% | 10.80% | |
| LPB $(*)_3$ | 10.80% | 9.00% | 7.20% | | | | 20.00% |

TABLE 9-continued

| Item | Example No. Comparative Example 32 | 33 | 34 | 35 | 36 | 37 | 38 |
|---|---|---|---|---|---|---|---|
| LAO $(*)_4$ | | | | 10.80% | 9.00% | 7.20% | |
| CH $(*)_5$ | | | | | | | |
| LSB $(*)_2$ | | | | | | | |
| Compound of Example 2 | | | | | | | |
| Coconut oil fatty acid diethanolamide | 2% | 2% | 2% | 2% | 2% | 2% | |
| pH adjuster | pH = 6.5 | pH = 6.5 | pH = 6.5 | pH = 6.5 | pH = 6.5 | pH = 6.5 | pH = 6.5 |
| Refined water | Balance | Balance | Balance | Balance | Balance | Balance | Balance |
| LMA | 0.4 | 0.5 | 0.6 | 0.4 | 0.5 | 0.6 | 1.0 |
| Amphoteric surfactant | 0.6 | 0.5 | 0.4 | 0.6 | 0.5 | 0.4 | 0.0 |
| Measured viscosity (mPa · s) | 325 | 80 | 27 | 4000 | 1220 | 163 | 5 |
| Stability at low temperature | 3 | 3 | 3 | 3 | 3 | 3 | 1 |
| Initial foaming property (mm) | 191.5 | 192.1 | 192.3 | 193.1 | 192.2 | 192.8 | 190.1 |
| Foam quality use test | 1 | 3 | 3 | 1 | 3 | 3 | 1 |

Tables 7 to 8 clearly show that the anionic surfactants having, as a hydrophylic group, a carboxyl group as shown in Comparative Examples 29 to 31 exhibited no thickening effect even in the combination with the amphoteric surfactant. In this point, the anionic surfactant should be distinguished from the sulfur atom-containing anions.

When the combination of the surfactants was used in further combination with the hydroxyalkyl polyhydric alcohol ether compound prepared in Example 2 in the resultant composition, a thickening effect was realized, as shown in Examples 24 to 26.

The detergent composition of Comparative Example 38 which was a standard in the evaluation of feeling in use, could provide a good feeling after using. However, this detergent composition exhibited an insufficient foaming property and poor voluminosity of the foam. By mixing the hydroxyalkyl polyhydric alcohol ether compound of the present invention, the resultant detergent composition could exhibit an increased voluminosity of foam and a pleasant feel in practical use.

Accordingly, to thicken and increase the viscosity of the liquid detergent containing an anionic surfactant having, as a hydrophilic group, a carboxyl group, the anionic surfactants must be used in combination with at least one member selected from acetic acid betaine type surfactants, amidoamine type amphoteric surfactants represented by the general formula (5), dipolar-ionic surfactants, and semipolar-ionic surfactants and further with the hydroxyalkyl polyhydric alcohol ether compound-containing thickening agent.

Also, in the detergent component containing the anionic surfactants having, as a hydrophilic group, a carboxyl group, in combination with at least one surfactant selected from acetic acid betaine type surfactants, amideamine type amphoteric surfactants represented by the general formula (5), dipolar-ionic surfactants and semipolar-ionic surfactants, when the content of the anionic surfactants having, as a hydrophilic group, a carboxyl group is less than 50% by weight, characteristic property of the anionic surfactants having, as a hydrophilic group, a carboxyl group could not be sufficiently appeared, while an improvement in forming property of the resultant composition could be realized.

Example 36

A germicidal hand soap composition was prepared in the following composition.

| Composition of hand soap | |
|---|---|
| Lauric acid | 6.0% by weight |
| 30% solution of lauric acid amidopropyldimethylamine oxide | 15.0% |
| 30% solution of POE (3) lauryl ether-acetic acid | 3.0% |
| 50% solution of benzalkonium chloride | 1.0% |
| 50% solution of benzethonium chloride | 0.5% |
| 1,2-propanediol monohydroxydodecyl ether | 2.0% |
| N-coconut oil fatty acid acyl-N'-carboxymethyl-N'-ethylenediamine sodium salt | 9.5% |
| Triethanolamine | An amount sufficient to adjust pH = 7.8 |
| Glycerol | 3.0% |
| Refined water | An amount necessary to adjust the total amount to 100% |

The above-mentioned components were mixed with each other, the mixture was heated to 80° C. to provide a uniform solution, and then cooled. The resultant hand soap composition was stored at −5° C. for 3 days. In the stored composition, no change in appearance was found. The viscosity of the composition was 570 mPa·s, determined by using a HM-2 rotor.

Example 37

A germicidal hand soap composition was prepared in the following composition.

| Composition of hand soap | |
|---|---|
| Lauric acid | 6.6% by weight |
| 30% solution of lauric acid amidopropyldimethylamine oxide | 15.0% |
| 30% solution of POE (3) lauryl ether-acetic acid | 3.0% |
| 50% solution of benzalkonium chloride | 1.0% |
| 50% solution of benzethonium chloride | 0.5% |
| 1,3-butanediol monohydroxydodecyl ether | 2.0% |
| N-coconut oil fatty acid acyl-N'-carboxymethyl-N'-ethylenediamine sodium salt | 9.5% |
| Triethanolamine | An amount sufficient to adjust pH = 7.8 |
| Glycerol | 3.0% |
| Refined water | An amount necessary to adjust the total amount to 100% |

The above-mentioned components were mixed with each other, the mixture was heated to 80° C. to provide a uniform solution, and then cooled. The resultant hand soap composition was stored at −5° C. for 3 days. In the stored composition, no change in appearance was found. The viscosity of the composition was 470 mPa·s, determined by using a HM-2 rotor.

Example 38

A body shampoo composition having a pearly gloss was prepared in the following composition.

| Composition of body shampoo | |
|---|---|
| Potassium salt of coconut oil fatty acid | 4.0% by weight |
| 30% solution of lauric acid amidopropyl betaine | 15.0% |
| 25% solution of sodium polyoxyethylene laurylsulfate | 20.0% |
| 30% solution of lauroyl-N-methyl-β-alanine sodium salt | 10.0% |
| 1,2-propanediol monohydroxydodecyl ether | 3.0% |
| Ethyleneglycol distearate | 2.0% |
| Glycerol | 3.0% |
| Citric acid | An amount sufficient to adjust pH = 7.5 |
| EDTA disodium salt | 0.2% |
| Methylparaben | 0.2% |
| Refined water | An amount necessary to adjust the total amount to 100% |

The above-mentioned components were mixed with each other, the mixture was heated to 8° C. to provide a uniform solution, and then cooled. The resultant hand soap composition was stored at −5° C. for 3 days. In the stored composition, no change in appearance was found. The viscosity of the composition was 2145 mPa·s, determined by using a HM-2 rotor.

Example 39

A body shampoo composition having a pearly gloss was prepared in the following composition.

| Composition of body shampoo | |
|---|---|
| Potassium salt of coconut oil fatty acid | 4.0% by weight |
| 30% solution of lauric acid amidopropyl betaine | 15.0% |
| 25% solution of sodium polyoxyethylene laurylsulfate | 20.0% |
| 30% solution of lauroyl-N-methyl-β-alanine sodium salt | 10.0% |
| 1,3-butanediol monohydroxydodecyl ether | 3.0% |
| Ethyleneglycol distearate | 2.0% |
| Glycerol | 3.0% |
| Citric acid | An amount sufficient to adjust pH = 7.5 |
| EDTA disodium salt | 0.2% |
| Methylparaben | 0.2% |
| Refined water | An amount necessary to adjust the total amount to 100% |

The above-mentioned components were mixed with each other, the mixture was heated to 80° C. to provide a uniform solution, and then cooled. The resultant hand soap composition was stored at −5° C. for 3 days. In the stored composition, no change in appearance was found. The viscosity of the composition was 1815 mPa·s, determined by using a HM-2 rotor.

Example 40

A shampoo composition was prepared in the following composition.

| Composition of shampoo | |
|---|---|
| 30% solution of lauric acid amidopropyldimethylamine oxide | 26.7% by weight |
| 30% solution of lauroyl-N-methyl-β-alanine sodium salt | 18.7% |
| 30% solution of lauric acid amidopropyldimethylamino-acetic acid betaine | 8.0% |
| 1,2-propanediol monohydroxydodecyl ether | 2.0% |
| Cationized cellulose | 0.5% |
| Pyrokuton auramine | 0.8% |
| Methylparaben | 0.2% |
| Propylparaben | 0.1% |
| EDTA disodium salt | 0.2% |
| Citric acid | An amount sufficient to adjust pH = 6.5 |
| Refined water | An amount necessary to adjust the total amount to 100% |

The above-mentioned components were mixed with each other, the mixture was heated to 80° C. to provide a uniform solution, and then cooled. The resultant hand soap composition was stored at −5° C. for 3 days. In the stored composition, no change in appearance was found. The viscosity of the composition was 4660 mPa·s, determined by using a HM-2 rotor.

Example 41

A shampoo composition was prepared in the following composition.

| Composition of shampoo | |
|---|---|
| 30% solution of lauric acid amidopropyldimethylamine oxide | 8.3% by weight |
| Cetyl alcohol | 1.5% |
| 25% solution of POE (3) laurylethersulforic acid ether sodium salt | 52.0% |
| 50% solution of stearyltrimethyl ammonium chloride | 0.2 |
| 1,2-propanediol monohydroxydodecyl ether | 2.0% |
| Cationized cellulose | 0.5% |
| 60% solution of 1-hydroxyethane-1,1-diphosphonic acid | 0.2% |
| Methylparaben | 0.2% |
| Propylparaben | 0.1% |
| Perfume | 0.1% |
| Citric acid | An amount sufficient to adjust pH = 6.5 |
| Refined water | An amount necessary to adjust the total amount to 100% |

The resultant shampoo composition exhibited a high foam-forming property, no creaky feel in rinsing and a pleasant feel after shampooing and a moist feel after drying. The viscosity of the composition was 7560 mPa·s, determined by using HM-2 rotor.

Example 42

A shampoo composition was prepared in the following composition.

| Composition of shampoo | |
|---|---|
| 30% solution of lauric acid amidopropyldimethylamine oxide | 10.0% by weight |
| Behenyl alcohol | 0.8% |
| 25% solution of POE (3) laurylethersulfuric acid ester sodium salt | 52.0% |
| 60% solution of N-[3-alkyl(12,14)oxy-2-hydroxypropyl]-L-arginine hydrochloric acid salt | 0.3% |
| 1,2-propanediol monohydroxydodecyl ether | 2.0% |
| Cationized cellulose | 0.3% |
| 60% solution of 1-hydroxyethane-1,1-diphosphonic acid | 0.5% |
| Methylparaben | 0.2% |
| Propylparaben | 0.1% |
| Perfume | 0.1% |
| Citric acid | An amount sufficient to adjust pH = 6.0 |
| Refined water | An amount necessary to adjust the total amount to 100% |

The resultant shampoo composition exhibited a nice and fine foam-forming property, no creaky feel in rinsing and a moist and soft feel after drying. The viscosity of the composition was 2035 mPa·s, determined by using HM-2 rotor.

Example 43

A shampoo composition was prepared in the following composition.

| Composition of shampoo | |
|---|---|
| 30% solution of lauric acid amidopropyldimethylamine oxide | 11.7% by weight |
| Stearyl alcohol | 0.4% |
| 25% solution of POE (3) laurylethersulfuric acid ester sodium salt | 28.0% |
| 30% solution of lauric acid amidopropyldimethylamino-acetic acid betaine | 11.7% |
| 1,2-propanediol monohydroxydodecyl ether | 1.0% |
| Cationized cellulose | 0.3% |
| 60% solution of 1-hydroxyethane-1,1-diphosphonic acid | 0.2% |
| Citric acid | 0.3% |
| Methylparaben | 0.2% |
| Propylparaben | 0.1% |
| Perfume | 0.2% |
| Citric acid | An amount sufficient to adjust pH = 6.5 |
| Refined water | An amount necessary to adjust the total amount to 100% |

The resultant shampoo composition exhibited a very nice, and fine foam-forming property, no creaky feel in rinsing and a moist feel after drying. The shampooed hair exhibited a pleasant combing property. The viscosity of the composition was 6520 mPa·s, determined by using HM-2 rotor.

Example 44

A shampoo composition was prepared in the following composition.

| Composition of shampoo | |
|---|---|
| 30% solution of lauric acid amidopropyldimethylamine oxide | 11.7% by weight |
| Stearyl alcohol | 0.4% |
| 25% solution of POE (3) laurylethersulfuric acid ester sodium salt | 28.0% |
| 30% solution of N-coconut oil fatty acid acyl-N'-carboxymethyl-N'-ethylenediamine sodium salt (desalted) | 11.7% |
| 1,3-butanediol monohydroxydodecyl ether | 1.5% |
| Cationized cellulose | 0.3% |
| 60% solution of 1-hydroxyethane-1,1-diphosphonic acid | 0.2% |
| Citric acid | 0.6% |
| Methylparaben | 0.2% |
| Propylparaben | 0.1% |
| Perfume | 0.1% |
| Citric acid | An amount sufficient to adjust pH = 6.5 |
| Refined water | An amount necessary to adjust the total amount to 100% |

The resultant shampoo composition exhibited a very nice, fine and soft foam-forming property, and no creaky feel in rinsing and a moist feel after drying. The shampooed hair exhibited a pleasant combing property. The viscosity of the composition was 5780 mPa·s, determined by using HM-2 rotor.

Example 45

A shampoo composition was prepared in the following composition.

| Composition of shampoo | |
|---|---|
| 30% solution of lauric acid amidopropyldimethylamine oxide | 13.3% by weight |
| Stearyl alcohol | 0.4% |
| 25% solution of POE (3) laurylethersulfuric acid ester sodium salt | 40.0% |
| POE (4.2) laurylether | 1.5% |
| 1,2-propanediol monohydroxydodecyl ether | 1.0% |
| Polyether-modified silicone | 0.3% |
| 60% solution of 1-hydroxyethane-1,1-diphosphonic acid | 0.2% |
| Saline | 0.3% |
| Methylparaben | 0.2% |
| Propylparaben | 0.1% |
| Perfume | 0.1% |
| Citric acid | An amount sufficient to adjust pH = 6.0 |
| Refined water | An amount necessary to adjust the total amount to 100% |

The resultant shampoo composition exhibited a nice, fine and creamy foam-forming property, no creaky feel in rinsing, a pleasant feel after shampooing and a moist feel after drying. The dried hair exhibited smooth and non-unkempt feeling. The viscosity of the composition was 4660 mPa·s, determined by using HM-2 rotor.

Example 46

A shampoo composition was prepared in the following composition.

| Composition of shampoo | |
|---|---|
| 30% solution of lauric acid amidopropyldimethylamine oxide | 26.7% by weight |
| Stearyl alcohol | 0.3% |
| 30% solution of lauroyl-N-methyl-β-alanine sodium salt | 18.7% |
| 30% solution of lauric acid amidopropyldimethylamino-acetic acid betaine | 8.0% |
| 1,2-propanediol monohydroxydodecyl ether | 2.0% |
| 1,3-butanediol | 2.0% |
| 60% solution of 1-hydroxyethane-1,1-diphosphonic acid | 0.5% |
| Citric acid | 0.6% |
| Methylparaben | 0.2% |
| Propylparaben | 0.1% |
| Perfume | 0.1% |
| Citric acid | An amount sufficient to adjust pH = 6.5 |
| Refined water | An amount necessary to adjust the total amount to 100% |

The resultant shampoo composition exhibited a very nice, fine and creamy foam-forming property, no creaky feel in rinsing, and a significant moist feel after drying. The shampooed hair exhibited a smooth combing property. The viscosity of the composition was 2005 mPa·s, determined by using HM-2 rotor.

Example 47

A shampoo composition was prepared in the following composition.

| Composition of shampoo | |
|---|---|
| 30% solution of lauric acid amidopropyldimethylamine oxide | 16.7% by weight |
| 30% solution of lauroyl-N-methyl-β-alanine sodium salt | 33.3% |
| 30% solution of lauric acid amidopropyldimethylamino-acetic acid betaine (desalted) | 6.7% |
| 50% solution of stearyltrimethyl ammonium chloride | 0.3% |
| 1,2-propanediol monohydroxydodecyl ether | 2.0% |
| 60% solution of 1-hydroxyethane-1,1-diphosphonic acid | 0.2% |
| Citric acid | 0.6% |
| Methylparaben | 0.2% |
| Propylparaben | 0.1% |
| Perfume | 0.1% |
| Citric acid | An amount sufficient to adjust pH = 6.5 |
| Refined water | An amount necessary to adjust the total amount to 100% |

The resultant shampoo composition exhibited a nice and fine foam-forming property, no creaky feel in rinsing and a moist and smooth feel after drying. The viscosity of the composition was 715 mPa·s, determined by using HM-2 rotor.

Example 48

A shampoo composition was prepared in the following composition.

| Composition of shampoo | |
|---|---|
| 30% solution of lauric acid amidopropyldimethylamine oxide | 13.3% by weight |
| Stearyl alcohol | 0.3% |
| 30% solution of N-lauroylglycine potassium salt | 33.3% |
| 30% solution of lauric acid amidopropyldimethylamino-acetic acid betaine (desalted) | 10.0% |
| 75% solution of distearyldimethyl ammonium chloride | 0.2% |
| 1,2-propanediol monohydroxydodecyl ether | 2.0% |
| 60% solution of 1-hydroxyethane-1,1-diphosphonic acid | 0.3% |
| Citric acid | 0.6% |
| Methylparaben | 0.2% |
| Propylparaben | 0.1% |
| Perfume | 0.2% |
| Citric acid | An amount sufficient to adjust pH = 6.5 |
| Refined water | An amount necessary to adjust the total amount to 100% |

The resultant shampoo composition exhibited a very nice and fine foam-forming property, no creaky feel in rinsing and a moist feel after drying. The dried hair exhibited a smooth combing property. The viscosity of the composition was 2500 mPa·s, determined by using HM-2 rotor.

Example 49

A shampoo composition was prepared in the following composition.

| Composition of shampoo | |
|---|---|
| 30% solution of lauric acid amidopropyldimethylamine oxide | 20.0% by weight |
| Stearyl alcohol | 0.3% |
| 30% solution of N-coconut oil fatty acid acyl glutamic acid triethanolamine salt | 33.3% |
| 30% solution of lauric acid amidopropyldimethylamino-acetic acid betaine (desalted) | 3.3% |
| 60% solution of N-[3-alkyl(12,14)oxy-2-hydroxypropyl]-L-arginine hydrochloric acid salt | 0.3% |
| 1,2-propanediol monohydroxydodecyl ether | 1.5% |
| 60% solution of 1-hydroxyethane-1,1-diphosphonic acid | 0.3% |
| Citric acid | 0.6% |
| Methylparaben | 0.2% |
| Propylparaben | 0.1% |
| Perfume | 0.1% |
| Citric acid | An amount sufficient to adjust pH = 5.8 |
| Refined water | An amount necessary to adjust the total amount to 100% |

The resultant shampoo composition exhibited a high foaming property, no creaky feel in rinsing and a moist feel after drying. The dried hair had a smooth combing property. The viscosity of the composition was 1090 mPa·s, determined by using HM-2 rotor.

Example 50

A shampoo composition was prepared in the following composition.

| Composition of shampoo | |
|---|---|
| 30% solution of lauric acid amidopropyldimethylamine oxide | 20.0% by weight |
| Behenyl alcohol | 0.2% |
| 30% solution of lauroyl-N-methyl-β-alanine sodium salt | 33.3% |
| 30% solution of N-lauroyl-N'-carboxymethyl-N'-ethylenediamine sodium salt (desalted) | 3.3% |
| Lauroylamide guanidine hydrochloric acid salt | 0.1% |
| 1,2-propanediol monohydroxydodecyl ether | 2.0% |
| 60% solution of 1-hydroxyethane-1,1-diphosphonic acid | 0.3% |
| Citric acid | 0.6% |
| Methylparaben | 0.2% |
| Propylparaben | 0.1% |
| Perfume | 0.1% |
| Citric acid | An amount sufficient to adjust pH = 6.5 |
| Refined water | An amount necessary to adjust the total amount to 100% |

The resultant shampoo composition exhibited a very fine and soft foam-forming property, no creaky feel in rinsing, a pleasant and soft feel after shampooing and a moist feel after drying. The dried hair had a smooth combing property. The viscosity of the composition was 986 mPa·s, determined by using HM-2 rotor.

INDUSTRIAL APPLICABILITY

The thickening agent comprising a hydroxyalkyl polyhydric alcohol ether compound of the present invention is useful for preparing a liquid detergent composition by mixing the thickening agent with a detergent. The resultant liquid detergent composition exhibits an increased viscosity, a satisfactory stability at low temperature and an initial foaming property in practical use, a excellent foam quality and gives a nice feeling to users in practical use. Thus the thickening agent of the present invention has an excellent performance in practical use.

The invention claimed is:

1. A liquid detergent composition comprising

A) a thickening agent comprising at least one hydroxyalkyl polyhydric alcohol ether compound of formula (1) or (2)

(1)

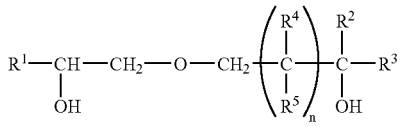

(2)

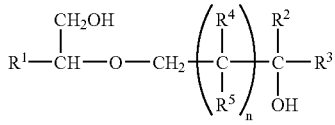

wherein $R^1$ is an alkyl or alkenyl group having 8 to 18 carbon atoms, $R^2$, $R^3$, $R^4$ and $R^5$ are, independently from each other, a hydrogen atom or an alkyl group having 1 to 3 carbon atoms, and n is an integer of 0 to 3 and

B) a liquid detergent component comprising at least one of (a), (b), (c) or (d):

(a) an acetic acid betaine amphoteric surfactant of formula (14):

(14)

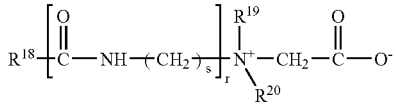

wherein r is an integer of 0 or 1, $R^{18}$ is an alkyl or alkenyl group having 10 to 18 carbon atoms when r is 0, or a fatty acid residue having 10 to 18 carbon atoms when r is 1, $R^{19}$ and $R^{20}$ are, independently from each other, a hydrogen atom or a methyl or ethyl group, and s is an integer of 2 or 3;

(b) an amidoamine amphoteric surfactant of formula (5):

(5)

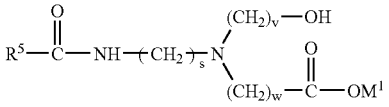

wherein $R^6$—CO is a residue group of an aliphatic acid having 10 to 18 carbon atoms, s is an integer of 2 or 3, and $M^1$ is an alkali metal atom or an alkanolamine residue group, and v and w are, independently of each other, an integer of 1 to 3, (c) a sulfo betaine dipolar-ionic surfactant of formula (13):

(13)

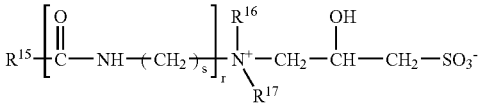

wherein r is an integer of 0 or 1, $R^{15}$ is an alkyl or alkenyl group having 10 to 18 carbon atoms when r is 0, or a fatty acid residue having 10 to 18 carbon atoms when r is 1, $R^{16}$ and $R^{17}$ are, independently from each other, a hydrogen atom or a methyl or ethyl group, and s is an integer of 2 or 3;

or (d) a semipolar-ionic surfactant of formula (16):

(16)

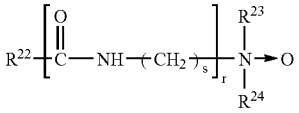

wherein r is an integer of 0 or 1, $R^{22}$ is an alkyl or alkenyl group having 10 to 18 carbon atoms when r is 0, or a fatty acid residue having 10 to 18 carbon atoms when r is 1, $R^{23}$ and $R^{24}$ are, independently from each other, a hydrogen atom or a methyl or ethyl group, and s is an integer of 2 or 3.

2. A liquid detergent composition according to claim 1, wherein in the compound of formula (1) or (2), both $R^4$ and $R^5$ are hydrogen atoms and one of $R^2$ and $R^3$ is a methyl group.

3. A liquid detergent composition according to claim 1, wherein the compound of formula (1) or (2) has a HLB value of 6 to 9, determined in accordance with the Organic Conception Diagram.

4. A liquid detergent composition according to claim 1, wherein the compound of formula (1) or (2) is a condensation reaction product of a 1,2-epoxy compound of formula (3) with an aliphatic diol compound of formula (4):

(3)

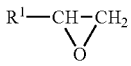

(4)

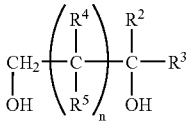

wherein $R^1$ is an alkyl or alkenyl group having 8 to 18 carbon atoms, $R^2$, $R^3$, $R^4$ and $R^5$ are, independently from each other, a hydrogen atom or an alkyl group having 1 to 3 carbon atoms, and n is an integer of 0 to 3.

5. A liquid detergent composition according to claim 4, wherein the compound of formula (4) is 1,2-propane diol, 1,2-butane diol or 1,3-butane diol.

6. A liquid detergent composition according to claim 1, wherein A) and B) are present at a dry mass ratio of 1:99 to 40:60.

7. A liquid detergent composition according to claim 2, wherein the compound of formula (1) or (2) has a HLB value of 6 to 9, determined in accordance with the Organic Conception Diagram.

8. A liquid detergent composition according to claim 2, wherein the compound of formula (1) or (2) is a condensation reaction product of a 1,2-epoxy compound of formula (3) with an aliphatic diol compound of formula (4):

(3)

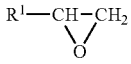

(4)

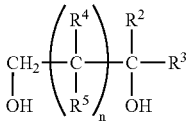

wherein $R^1$ is an alkyl or alkenyl group having 8 to 18 carbon atoms, $R^2$, $R^3$, $R^4$ and $R^5$ are, independently from each other, a hydrogen atom or an alkyl group having 1 to 3 carbon atoms, and n is an integer of 0 to 3.

9. A liquid detergent composition according to claim 8, wherein the compound of formula (4) is 1,2-propane diol, 1,2-butane diol or 1,3-butane diol.

10. A liquid detergent composition according to claim 2, wherein A) and B) are present at a dry mass ratio of 1:99 to 40:60.

* * * * *

UNITED STATES PATENT AND TRADEMARK OFFICE

CERTIFICATE OF CORRECTION

PATENT NO. : 7,138,365 B2
APPLICATION NO. : 10/484308
DATED : November 21, 2006
INVENTOR(S) : Tomohiro Murayama It is certified that error appears in the above-identified patent and that said Letters Patent is hereby corrected as shown below:

On the Title page, Assignee: reads "Chemical" should read -- Chemicals --
Column 39, line 6, in formula (5), reads "$R^{5}$" should read -- $R^{6}$ --

Signed and Sealed this

Tenth Day of July, 2007

JON W. DUDAS
*Director of the United States Patent and Trademark Office*